US005466983A

United States Patent [19]

Shirai et al.

[11] Patent Number: 5,466,983

[45] Date of Patent: Nov. 14, 1995

[54] CATHODE RAY TUBE WITH IMPROVED RESOLUTION

[75] Inventors: Shoji Shirai, Mobara; Kenichi Watanabe, Ohtaki; Shoichi Wakita, Ichihara, all of Japan

[73] Assignee: Hitachi, Ltd., Tokyo, Japan

[21] Appl. No.: 194,500

[22] Filed: Feb. 10, 1994

[30] Foreign Application Priority Data

Feb. 24, 1993 [JP] Japan ..... 5-035497

[51] Int. Cl.[6] ..... H01J 29/46

[52] U.S. Cl. ..... 313/414; 313/460; 315/15

[58] Field of Search ..... 313/409, 412, 313/414, 449, 452, 460; 315/15, 368.16

[56] References Cited

U.S. PATENT DOCUMENTS

| | | | |
|---|---|---|---|
| 4,344,017 | 8/1982 | Nosaka . | |
| 4,383,199 | 5/1983 | Washino et al. | 315/15 |
| 4,814,670 | 3/1989 | Susuki et al. | 315/15 |
| 4,967,120 | 10/1990 | Katsuma et al. | 315/15 |
| 5,055,749 | 10/1991 | Chen et al. . | |
| 5,164,640 | 11/1992 | Son et al. | 315/15 |
| 5,194,778 | 3/1993 | Koh | 315/15 |
| 5,281,896 | 1/1994 | Bae et al. | 315/15 |

*Primary Examiner*—Sandra L. O'Shea
*Assistant Examiner*—Vip Patel
*Attorney, Agent, or Firm*—Antonelli, Terry, Stout & Kraus

[57] ABSTRACT

A cathode ray tube has a gun electrode construction which elongates horizontally a cross section of an electron beam and whose elongating strength weakens as a focusing voltage increases.

24 Claims, 6 Drawing Sheets

FIG. 2 (a) (PRIOR ART)
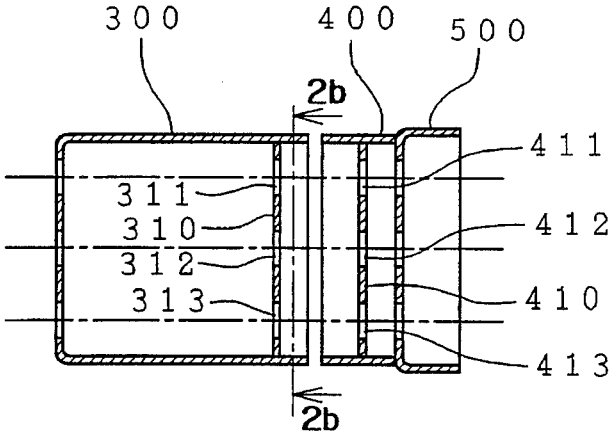
FIG. 2 (b) (PRIOR ART)
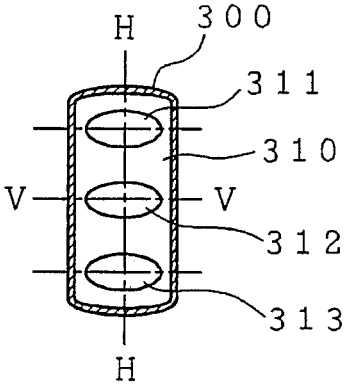
FIG. 3 (a)
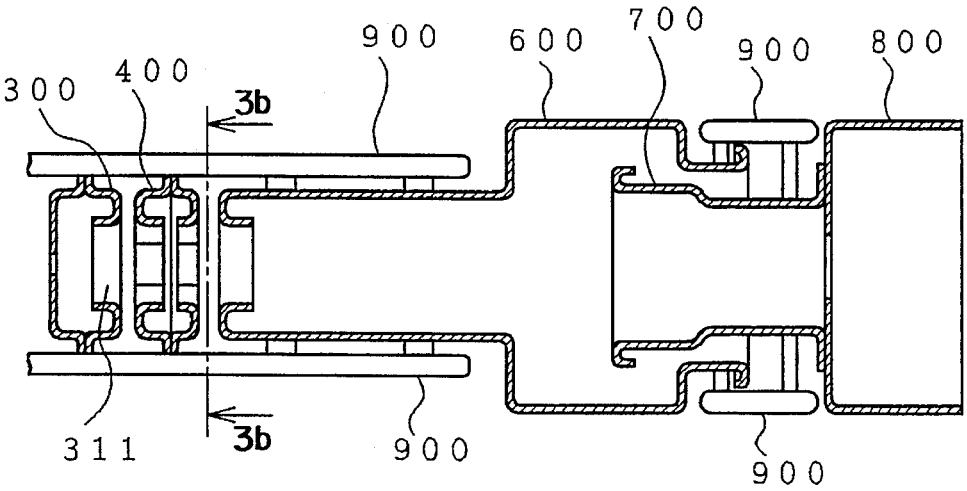
FIG. 3 (b)
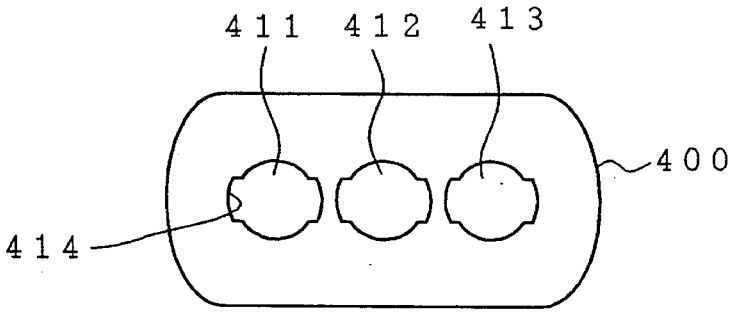

CATHODE RAY TUBE WITH IMPROVED RESOLUTION

BACKGROUND OF THE INVENTION

The present invention relates to a cathode ray tube and more specifically to a cathode ray tube which uses an electron gun having a main lens with reduced aberration to improve resolution of images displayed on a direct-view or projection television set or on a display device of information terminal equipment.

Cathode ray tubes are widely used as a display device for direct-view TV, projection TV and information terminal equipment.

This kind of cathode ray tube includes in a vacuum envelope at least an electron gun that emits electron beams and a phosphor screen applied with a phosphor material that illuminates when excited by the bombardment of electrons. The resolution of a displayed image depends on the size and shape of a spot of the electron beam on the phosphor screen.

Because the size and shape of the electron beam spot on the phosphor screen depend on the focusing characteristics of the electron gun, the arrangement and shape of electrodes constituting a lens of the electron gun are extremely important in improving the resolution.

FIG. 1 is a schematic cross-sectional view of a color cathode ray tube showing one example structure of a conventional cathode ray tube and its electron gun. Denoted 1 is a glass envelope, which is a vacuum vessel; 2 a faceplate panel that provides a display screen; 3 a phosphor screen, which is a layer of three-color phosphor material formed over the inner surface of the faceplate panel 2; 4 a shadow mask that forms a color selection electrode; 5 an inner conductive film to be applied with an anode voltage; and 6 an external magnetic deflection yoke. Reference numerals 7, 8 and 9 represent cathodes; 10 a first grid electrode (G1 electrode); 20 a second grid electrode (G2 electrode); 30 a third grid electrode (G3 electrode); 40 a fourth grid electrode (G4 electrode); and 50 a shield cup. The third grid electrode 30 has electron beam passage openings 31, 32 and 33 formed on the side of the fourth grid electrode. The fourth grid electrode 40 has electron beam passage openings 41, 42 and 43 formed on the side of the third grid electrode. The shield cup 50 has electron beam passage openings 51, 52 and 53. Designated 61, 62 and 63 are center axes of three electron beams arranged almost parallel to each other on a horizontal plane. Denoted 64 and 65 are center axes of the side electron beam passage openings 41, 43 of the fourth grid electrode 40 on the third grid electrode side.

In the figure, the cathodes 7, 8, 9, the first grid electrode 10, the second grid electrode 20, the third grid electrode 30, the fourth grid electrode 40, and the shield cup 50 combine to form an electron gun, with the cathodes 7, 8, 9, the first grid electrode 10 and the second grid electrode 20 forming a beam generator section.

The beam generator section emits electron beams along the center axes 61, 62, 63 arranged on a horizontal plane. The electron beams enter a main lens section formed in a space between the third grid electrode 30 and the fourth grid electrode 40.

The main lens section is formed by the third and fourth electrodes 30, 40, which are the main lens electrodes, and the shield cup 50. The center axes of the electron beam passage openings formed in the third electrode 30' one of the two main lens electrodes, and in the shield cup 50 are aligned with the corresponding center axes 61, 62, 63 of the electron beams. As to the electron beam passage openings formed in the fourth electrode 40' the other of the two main lens electrodes, on the third electrode side, the center axis of the center electron beam passage opening 42 coincide with the center axis 62 of the center beam, whereas the center axes 64, 65 of the side electron beam passage openings 41, 43 are not in line with the beam axes 61, 63, respectively and are slightly shifted outwardly.

The potential of the third grid electrode 30 is set lower than that of the fourth grid electrode 40. The higher-potential fourth grid electrode 40 is set equal in potential to the shield cup 50 and the inner conductive film 5.

Since the center electron beam passage openings 32 and 42 of the third and fourth grids 30, 40 are coaxial with each other, an axially symmetrical main lens is formed at the central portion between the third and fourth grid electrodes 30 and 40. The center electron beam is focused by this main lens and advances straight along the center axis 62.

On the other hand, the side electron beam passage openings 31, 33 of the third grid electrode 30 and the outer electron beam passage openings 41, 43 of the fourth grid electrode 40 are out of alignment with each other in their center axes, so that they form axially non-symmetrical main lenses for side electron beams.

In diverging lens regions formed on the fourth grid electrode 40 side of the main lens regions, the side electron beams therefore pass through each lens at a point deviated from the lens center axis toward the center electron beam, so that they are subjected to the focusing action of the main lenses and also to a force urging the beams toward the center beam.

In this way, the three electron beams are focused and at the same time converged so that they overlap each other on the shadow mask 4. The operation for converging these electron beams is referred to as a static convergence.

The electron beams are color-selected by the shadow mask 4 so that only a part of each electron beam that will excite a phosphor area of the corresponding color passes through apertures of the shadow mask 4 and strikes the phosphor screen 3. A deflection magnetic field generated by the external magnetic deflection yoke 6 causes the electron beams to perform a two-dimensional scan on the phosphor screen 3.

The spherical aberration of the main lens is generally known to be a major factor that has a great effect on the resolution characteristic of the aforementioned color cathode ray tube. Reducing the spherical aberration of the main lens will reduce deterioration in the resolution caused by an increase in the spot diameter on the phosphor screen.

It is also known that increasing the diameters of apertures in the electrodes making up the main lens is effective for reducing the spherical aberration of the main lens.

In the in-line type electron gun shown in FIG. 1, however, since the three main lenses of cylinder type corresponding to the three primary colors, red (R), green (G) and blue (B), are arranged in the same plane, the diameters of apertures in the electrodes must be less than one third of the inner diameter of the neck portion of the glass envelope 1. Considering the thickness of electrodes and also problems with electrode manufacturing, the upper limits of diameters of apertures in the electrodes will further decrease. Increasing the inner diameter of the neck portion for the purpose of raising this limit will give rise to another drawback of an increase in the deflection power of the deflection yoke 6 arranged on the outside of the neck portion.

One example of a non-cylindrical main lens whose diameter can be increased virtually beyond the above limit is disclosed in the Japanese Patent Laid-Open No. 103752/1983.

FIG. 2 (*a*) and FIG. 2 (*b*) are cross sections showing essential portions of an electron gun having the non-cylindrical lens disclosed in the above-mentioned publication. FIG. 2(*a*) is a longitudinal cross section and FIG. 2 (*b*) is a transverse cross section taken along the line 2*b*—2*b* of FIG. 2(*a*). In these figures, designated 300 is a third grid electrode, 400 a fourth grid electrode, 500 a shield cup, 310 a first electrode plate, 311, 312 and 313 electron beam passage openings in the first electrode plate, 410 a second electrode plate, and 411, 412 and 413 electron beam passage openings in the second electrode plate.

As shown in FIG. 2(*a*), the first electrode plate 310 and the second electrode plate 410 installed at the facing surfaces of the third grid electrode 300 and the fourth grid electrode 400 are set back away from the facing surfaces. As a result, the electric field can penetrate deep into the interior of the third grid electrode 300 and the fourth grid electrode 400, producing the same effect as that obtained when the lens diameter is increased.

The peripheral portion of the cross section of the grid electrodes, however, is not axially symmetrical and its horizontal length in a direction H—H is longer than the vertical length in a direction V—V. Hence, the penetration of the electric field is conspicuously large in the horizontal direction so that the lens focusing force in the horizontal direction becomes weaker than in the vertical direction. This gives rise to an astigmatism, which causes the cross-sectional shape of the electron beam to flatten horizontally, resulting in a lowered resolution.

To correct this problem, the electron beam passage openings 311,312, 313 formed in the first electrode 310 and the electron beam passage openings 411,412, 413 formed in the second electrode 410 are made non-circular in cross section in such a way that their horizontal diameters are smaller than their vertical diameters. This strengthens the horizontal focusing field, balancing the horizontal and vertical focusing forces, and eliminating the astigmatism.

With the conventional electrodes of the shape mentioned above, however, it is not possible to take full advantage of the effect of the enlarged lens diameter for the following reason.

To make full use of the effect of the enlarged lens diameter, it is necessary to expand the electron beam diameter in the main lens. Enlarging the electron beam diameter beyond a certain level, however, results in a part of the electron beam striking the first electrode plate 310. These striking electrons flow into the third grid electrode 300 generating a current. This current then flows to a power supply circuit that generates a focusing voltage, i.e. a voltage to be applied to the third grid electrode 300. Generally, the impedance of the power supply circuit is significantly large, so that the current reduces the output voltage or focusing voltage, making it impossible to operate the electron gun under normal focusing conditions.

Under these situations, it is conceivable to have a structure which eliminates the first electrode plate 310 and the second electrode plate 410. However, removing the first electrode plate 310 and the second electrode plate 410 results in an astigmatism and a significant reduction in the resolution because the peripheral portion of the grid electrode cross section is similar to the shape of a racetrack.

To correct the astigmatism the following means may be conceived. That is, attention is paid to the fact that only the third grid electrode 300 acts to horizontally elongate the electron beam and that the horizontally long cross section of the fourth grid electrode 400, on the contrary, acts to cause the electron beam to become vertically long in cross section. If the out-of-roundness of the peripheral portions of the third grid electrode 300 and of the fourth grid electrode 400 are equal, the electron beam is strongly influenced by the third grid electrode 300 because the electron beam travels slower in the low-voltage third grid electrode 300 and stays there longer. The overall result is that the electron beam is deformed horizontally long, causing the above-mentioned astigmatism.

SUMMARY OF THE INVENTION

The objective of this invention is to provide a cathode ray tube having a high resolution electron gun which can eliminate the aforementioned problems of the conventional art, which can increase the diameter of the main lens and which satisfies the electron beam focusing condition in the vertical direction.

To achieve the above objective, the present invention is characterized in that the first-stage lens is so constructed that its action weakens as the focusing voltage is increased to reduce the deformation of the cross section of the electron beam.

The present invention provides a plural-beam cathode ray tube having an electron gun including a beam generating section for generating a plurality of horizontally arranged and controlled electron beams and a main lens section including a pair of electrodes opposed to each other and each having a horizontally elongated transverse cross section and being impressed with a low voltage and a high voltage, respectively. The main lens section also includes an electrode arrangement for elongating horizontally a cross section of the electron beams entering the pair of electrodes and having at least one of its electrodes impressed with low voltage, wherein the elongating strength of the electrode arrangement for elongating horizontally the cross section of the electron beams decreases as the low voltage increases. In a preferred embodiment of this plural-beam cathode ray tube of the present invention, a degree of horizontal elongation of a cross section of the other electrode to which the high voltage is applied is larger than that of the one electrode to which the low voltage is applied.

The above invention is also characterized in that the electrode means is constructed in such a way that a first-stage lens electrode including the electrode to which the low voltage is applied and a second-stage lens electrode including the electrode to which a voltage higher than the low voltage is applied, are opposed to each other.

And the above invention is further characterized in that the horizontal diameter of an electron beam passage opening formed in the end surface of the first-stage lens electrode facing the second-stage lens electrode is larger than the diameter of the same opening in a direction perpendicular to the horizontal diameter.

Further, the invention is characterized in that the horizontal diameter of an electron beam passage opening formed in the end surface of the second-stage lens electrode facing the first-stage lens electrode is smaller than the diameter of the same opening in a direction perpendicular to the horizontal diameter.

The present invention also provides a single-beam cathode ray tube having an electron gun including a beam generating section for generating a single controlled electron beam and a main lens section including a pair of electrodes opposed to each other and each having a transverse cross section elongated in an arbitrary direction and being impressed with a low voltage and a high voltage, respectively. The main lens section also includes an electrode arrangement for elongating in the arbitrary direction a cross section of the electron beam entering the pair of electrodes and having at least one of its electrodes impressed with the low voltage, wherein the elongating strength of the electrode arrangement for elongating in the arbitrary direction the cross section of the electron beam decreases as the low voltage increases. In a preferred embodiment of this single-beam cathode ray tube of the present invention, a degree of the elongation in the arbitrary direction of a cross section of the other electrode to which the high voltage is applied is larger than that of the one electrode to which the low voltage is applied.

The above invention is further characterized in that the electrode arrangement is constructed in such a way that a first-stage lens electrode including the electrode to which the low voltage is applied and a second-stage lens electrode including the electrode to which a voltage higher than the low voltage is applied, are opposed to each other.

Another characteristic of this invention is that the first-stage lens electrode, including the electrode to which the low voltage is applied, has formed in its end surface facing the second-stage lens electrode an electron beam passage opening whose diameter in the arbitrary direction is larger than its diameter in a direction perpendicular to the arbitrary direction, the second-stage lens electrode including the electrode to which a voltage higher than the low voltage is applied.

Still another characteristic of this invention is that the first-stage lens electrode, including the electrode to which the low voltage is applied, has formed in its end surface facing the second-stage lens electrode an election beam passage opening whose diameter in the arbitrary direction is smaller than its diameter in a direction perpendicular to the arbitrary direction, the second-stage lens electrode including the electrode to which a voltage higher than the low voltage is applied.

In the above configuration of this invention, if the deformation of the electron beam cross section decreases as the focusing voltage is increased, the focusing action of the first-stage lens in the vertical direction weakens.

At this time, an increase in the focusing voltage applied to one of the electrodes that form the second-stage lens electrode results in a reduction in the voltage difference between the focusing voltage and the high voltage applied to the other electrode. This in turn reduces the action of the second-stage lens formed by the second-stage lens electrode. As a result, increasing the focusing voltage further weakens the focusing action in the vertical direction, shortening the distance from the main lens to the focus point of the beam.

By selecting the focusing voltage at an optimum value, it is therefore possible to provide conditions in which the electron beam focuses on the phosphor screen in the vertical direction, too.

BRIEF DESCRIPTION OF THE DRAWINGS

FIG. 2(*a*) and FIG. 2(*b*) are cross sections showing essential constructions of the electron gun having a conventional non-cylindrical main lens, FIG. 2(*a*) being a longitudinal cross section, FIG. 2(*b*) a transverse cross section taken along the line 2*b*—2*b* of FIG. 2(*a*);

FIG. 3(*a*) and FIG. 3(*b*) are cross sections showing an essential portion of the electron gun having an electrode structure to correct an astigmatism, FIG. 3(*a*) being a longitudinal cross section, FIG. 3(*b*) a transverse cross section taken along the line 3*b*—3*b* of FIG. 3(*a*);

DESCRIPTION OF THE PREFERRED EMBODIMENTS

Figure 1:
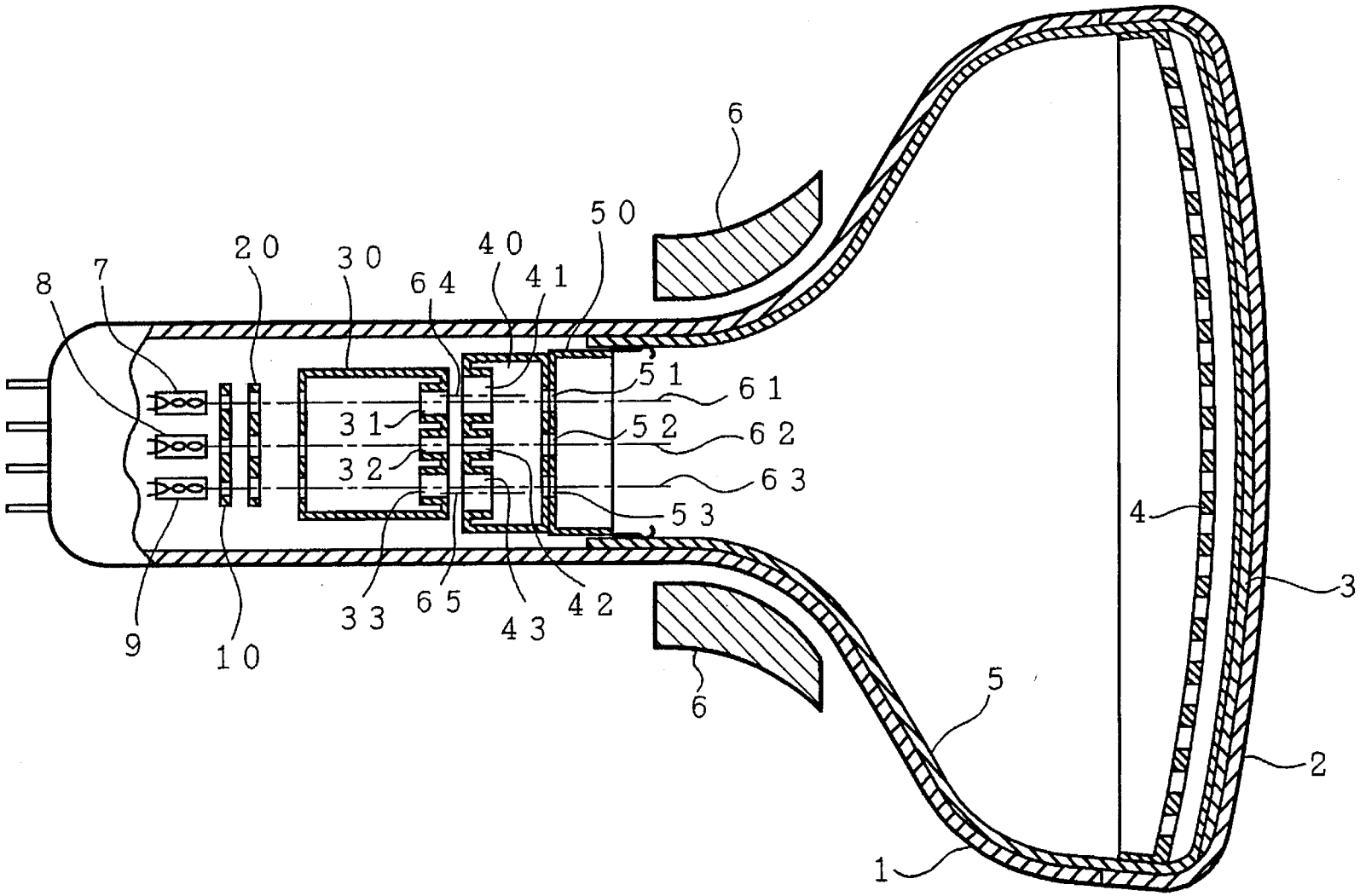
FIG. 1 (PRIOR ART)
FIG. 1 is a schematic cross section of a color cathode ray tube illustrating one example structure of a conventional cathode ray tube and its electron gun.

To correct the astigmatism explained in the Background of the Invention, the inventors of this invention proposed the following electron gun in Japanese Patent Laid-Open No. 62610/1993, whose patent application was filed with Japan Patent Office on September 5, 1991 and laid open on March 12, 1993 after the priority filing date of the present patent application.

FIG. 3(*a*) and FIG. 3(*b*) are cross sections showing essential portions of the above-mentioned electron gun which has an electrode structure to compensate for the astigmatism. FIG. 3(*a*) is a longitudinal cross section of the electron gun, and FIG. 3(*b*) is a transverse cross section of the same taken along the line 3*b*—3*b* of FIG. 3(*a*). Reference numeral 300 represents a third grid electrode, 400 a fourth grid electrode, 600 a fifth grid electrode, 700 a sixth grid electrode, 800 a shield cup, 900 an electrode support rod, and 411,412 and 413 electron beam passage openings in the fourth grid electrode.

As shown in FIGS. 3(*a*) and 3(*b*), making out-of-roundness in a cross section, that is, a degree of horizontal elongation of the sixth grid electrode 700 in its cross section greater than that of the fifth grid electrode 600 strengthens the lens action to vertically elongate the cross section of electron beam, offsetting the action of the fifth grid electrode 600 to horizontally elongate the beam cross section, thereby correcting the astigmatism.

In the structure of FIG. 3(*a*) and 3(*b*), however, since the diameter of the electrode periphery is smaller in the vertical direction than in the horizontal direction, the diameter of the main lens becomes smaller in the vertical direction than in the horizontal direction, causing an imbalance in the aberration, which in turn causes the electron beam spot on the phosphor screen to expand in the vertical direction.

In the electron gun shown in FIGS. 3(*a*) and 3(*b*), the main lens is formed as a multi-stage lens consisting of a first-stage lens and a second-stage lens, with the second-stage lens enlarged in diameter and with the first-stage lens so constructed as to elongate horizontally the cross section of the electron beam incident on the second-stage lens to correct the imbalance of the aberration.

The reason that the imbalance of the aberration can be rectified by elongating the electron beam cross section horizontally is as follows.

It is known that the aberration is proportional to the third power of the angle of incidence θ of the electron beam with respect to the lens axis. Horizontally elongating the cross section of the beam by the first-stage lens reduces the angle of incidence of the beam at the second-stage lens in the vertical direction, thereby minimizing the deterioration in focusing due to aberration caused by the small vertical diameter of the lens.

The first-stage lens consists of the third grid electrode 300, the fourth grid electrode 400 and the fifth grid electrode 600, while the second-stage lens is comprised of a fifth grid electrode 600 and the sixth grid electrode 700. In the electron gun shown in FIG. 3(*a*) and 3(*b*), the third grid electrode 300 and the fifth grid electrode 600 are impressed with a focusing voltage of approximately 5 to 10 kV, and the fourth grid electrode 400 is impressed with a low voltage of about 500 V to 1 kV. The electron beam passage openings 411, 412, 413 in the fourth grid electrode 400 are each formed with a horizontal slit 414, which elongate the cross sections of the electron beams horizontally as they pass through the first-stage lens.

With the color cathode ray tube having the above-mentioned electron gun, however, there is a problem arising from the construction of the electron gun. This is explained below.

When the electron beam cross section is elongated horizontally to a great degree by the first-stage lens, the electron beam is very strongly focused in the vertical direction.

As the focusing voltage is increased, the vertical focusing effect is further strengthened. This results in the distance from the main lens to the vertical focus point becoming shorter, so that no voltage condition exists that focuses the electron beam on the phosphor screen.

On the other hand, when the focusing voltage is lowered, the second-stage lens action becomes strong reducing the distance from the main lens to the horizontal and vertical focused point, and there is no voltage condition to focus the electron beam on the phosphor screen.

As explained above, when the electron beam cross section is elongated to a great degree by the first-stage lens, neither increasing nor reducing the focusing voltage may be able to vertically focus the electron beam on the phosphor screen.

The present invention provides a cathode ray tube having a high-resolution electron gun, which eliminates the aforementioned problem with the conventional art, which can increase the diameter of the main lens, and which enables vertical focusing of the electron beam on the phosphor screen.

Now, some embodiments of this invention will be described in detail by referring to the accompanying drawings.

EMBODIMENT 1

Figure 4:
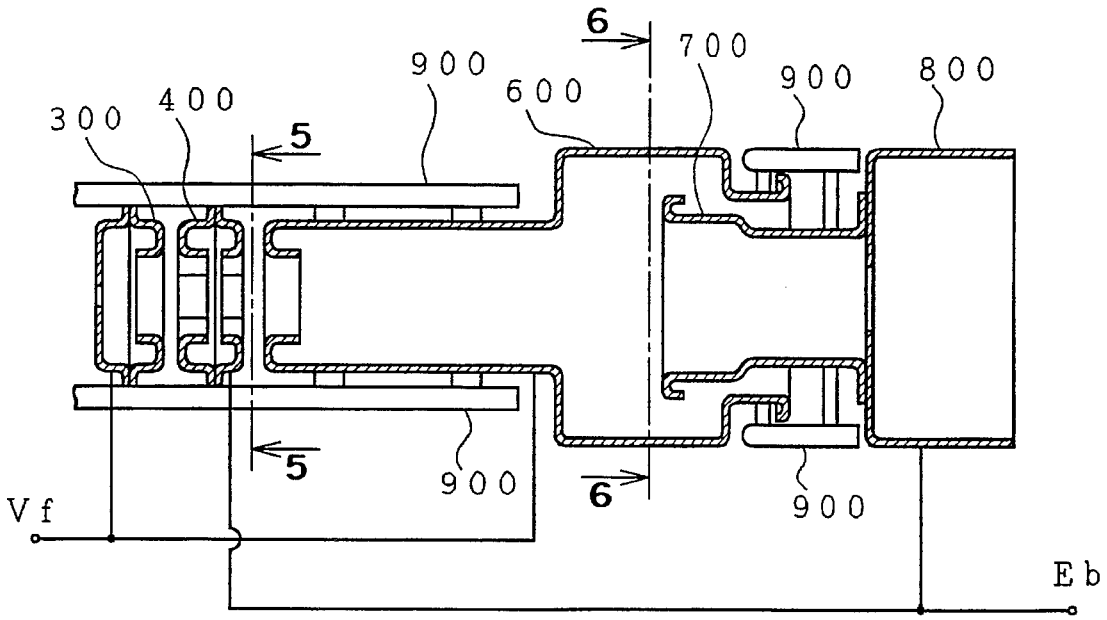
FIG. 4 is a longitudinal cross section showing the first embodiment of a main lens of an electron gun used in the cathode ray tube of this invention.
Figure 5:
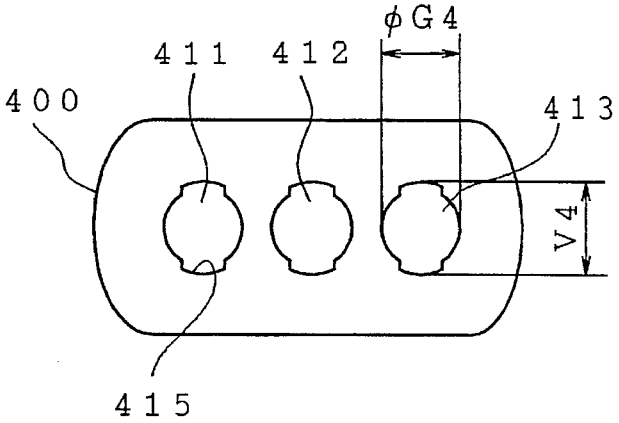
FIG. 5 is a transverse cross section of the main lens as seen from the direction of 5—5 of FIG. 4.
Figure 6:
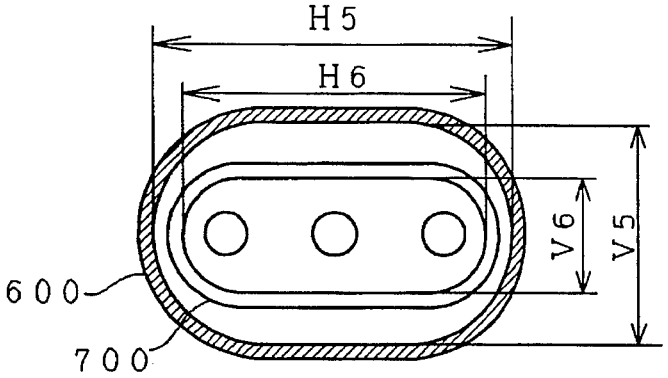
FIG. 6 is a transverse cross section of the main lens as seen from the direction of 6—6 of FIG. 4.

FIG. 4 is a longitudinal cross section showing the first embodiment of a main lens for the electron gun used in the cathode ray tube of this invention. FIG. 5 is a transverse cross section of the lens as seen from the 5—5 direction of FIG. 4. FIG. 6 is a transverse cross section of the lens as seen from the 6—6 direction of FIG. 4. As in FIG. 3(*a*) and 3(*b*), reference numeral 300 represents a third grid electrode, 400 a fourth grid electrode, 600 a fifth grid electrode, 700 a sixth grid electrode, 800 a shield cup, 900 an electrode support rod made of insulating material (for example, a glass rod), and 411, 412 and 413 electron beam passage openings in the fourth grid electrode. The electron beam passage openings in the third, fourth and fifth grid electrode are formed in cylindrical shapes.

In FIG. 4, the first-stage lens is formed by the third grid electrode 300, the fourth grid electrode 400 and the fifth grid electrode 600, while the second-stage lens is formed by the fifth grid electrode 600 and the sixth grid electrode 700.

In the example of FIG. 4, the third grid electrode 300 and the fifth grid electrode 600 are impressed with a focusing voltage (Vf) of about 5 to 10 kV. The fourth grid electrode 400 is impressed with a voltage of about 20 to 35 kV (anode voltage Eb), which is commonly applied also to the sixth grid electrode 700.

The fourth grid electrode 400, as shown in FIG. 5, is formed with electron beam passage openings 411, 412, 413, which are each formed with a vertical slit 415. The slit 415 elongates the cross section of the electron beam horizontally as it passes through the first-stage lens.

The fifth grid electrode 600 and the sixth grid electrode 700 are both horizontally elongated in a cross section, with a degree of out-of-roundness of the sixth grid electrode 700 being larger than that of the fifth grid electrode 600 to compensate for the astigmatism.

Because the cross section of the electron beam entering the second-stage lens is already elongated horizontally, the imbalance of spherical aberration that would be caused by the out-of-roundness of the second-stage lens can be compensated for, producing an almost circular electron beam spot on the phosphor screen.

Further, since the electron gun is so constructed that the action of the first-stage lens weakens as the focusing voltage increases, a problem does not occur that the electron beam fails to focus on the phosphor screen, as will happen when the vertical focusing action is too strong at all times.

Listed below is one example of electrode dimensions for the electron gun shown in FIG. 4 that were determined by a three-dimensional electron beam simulation.

H5 (horizontal diameter of the fifth grid electrode)=21 mm

H6 (horizontal diameter of the sixth grid electrode)=17 mm

V5 (vertical diameter of the fifth grid electrode)=14.9 mm

V6 (vertical diameter of the sixth grid electrode)=7.6 mm

V4 (vertical length of a slit in the fourth grid electrode)=4.8 mm

ϕG4 (diameter of the cylindrical portion of the third, fourth and sixth grid electrodes)=4.0 mm The electron beam spot on the phosphor screen produced by the electrodes of the above dimensions under the influence of spherical aberration has a degree of out-of-roundness (ratio of vertical diameter to horizontal diameter) of about 1.3, which represents nearly a circle. The spot diameters (horizontal and vertical diameters) with the spherical aberration is 28 percent smaller than the ones produced when the second-stage lens is ϕ15, testifying to the fact that the effective enlargement of the lens diameter contributes to a substantial improvement of aberration.

EMBODIMENT 2

Figure 7:
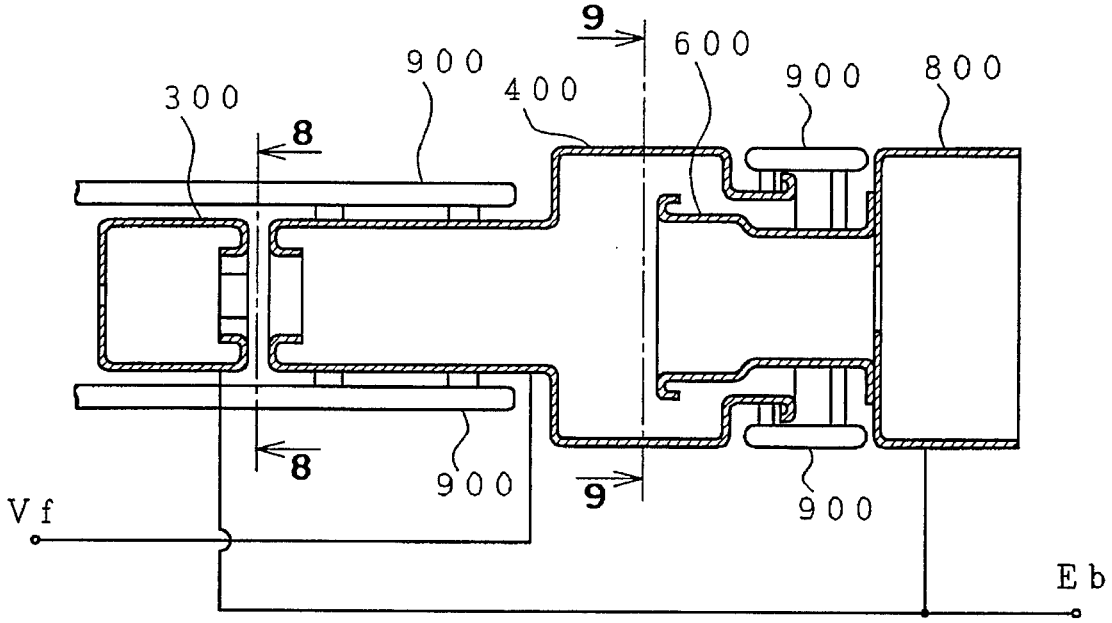
FIG. 7 is a longitudinal cross section showing the second embodiment of a main lens of an electron gun used in the cathode ray tube of this invention.
Figure 8:
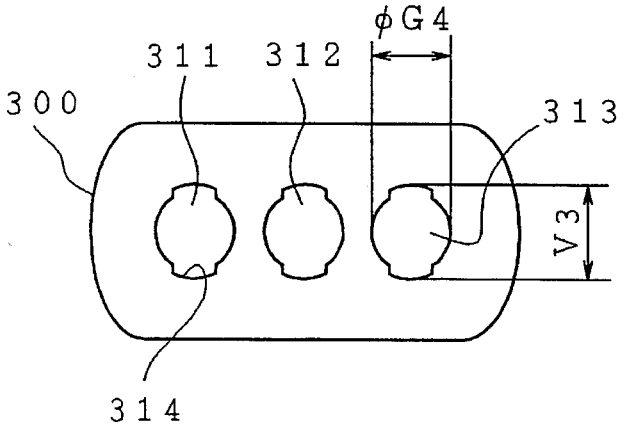
FIG. 8 is a transverse cross section of the main lens as seen from the direction of 8—8 of FIG. 7.
Figure 9:
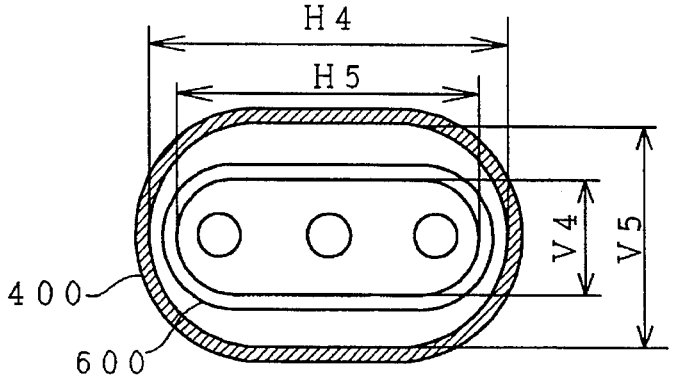
FIG. 9 is a transverse cross section of the main lens as seen from the direction of 9—9 of FIG. 7.

FIG. 7 is a longitudinal cross section of the second embodiment of the main lens of the electron gun used in the cathode ray tube according to this invention. FIG. 8 is a transverse cross section of the main lens as viewed from the 8—8 direction of FIG. 7. FIG. 9 is a transverse cross section of the main lens as seen from the 9—9 direction of FIG. 7. Reference numeral 300 represents a third grid electrode, 400 a fourth grid electrode, 600 a fifth grid electrode, 800 a shield cup, 900 an electrode support rod, and 311,312 and 313 electron beam passage openings in the third grid electrode. The electron beam passage openings in the third and fourth grid electrodes are formed in cylindrical shapes.

In the electron gun of this invention, the first-stage lens is formed by the third grid electrode 300 and the fourth grid electrode 400, while the second-stage lens is formed by the fourth grid electrode 400 and the fifth grid electrode 600.

In the example of FIG. 7, the third grid electrode 300 is impressed with a high voltage (anode voltage Eb) of 20 to 35 kV, which is also applied to the fifth grid electrode 600. The fourth grid electrode 400 is impressed with a focusing voltage (Vf) of about 5 to 10 kV.

The electron beam passage openings 311,312, 313 in the third grid electrode 300 are each formed with a vertical slit 314. The slits 314 elongate the cross section of the electron beam horizontally as it passes through the first-stage lens.

In this embodiment also, since the electron gun is so constructed that the action of the first-stage lens weakens as the focusing voltage increases, a problem does not occur that the electron beam fails to focus on the phosphor screen, as will happen when the vertical focusing action is too strong at all times.

EMBODIMENT 3

Figure 10:
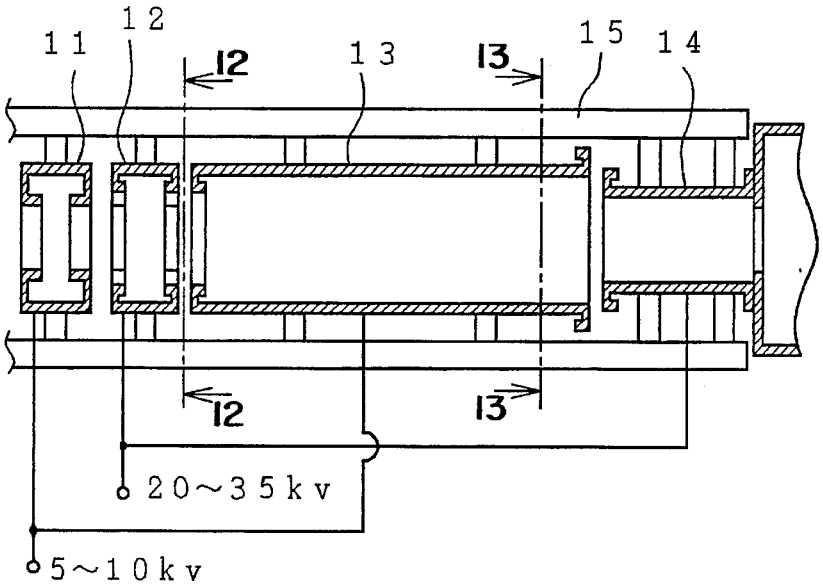
FIG. 10 is a schematic cross section showing a third embodiment of an electron gun used in the cathode ray tube of this invention.
Figure 11:
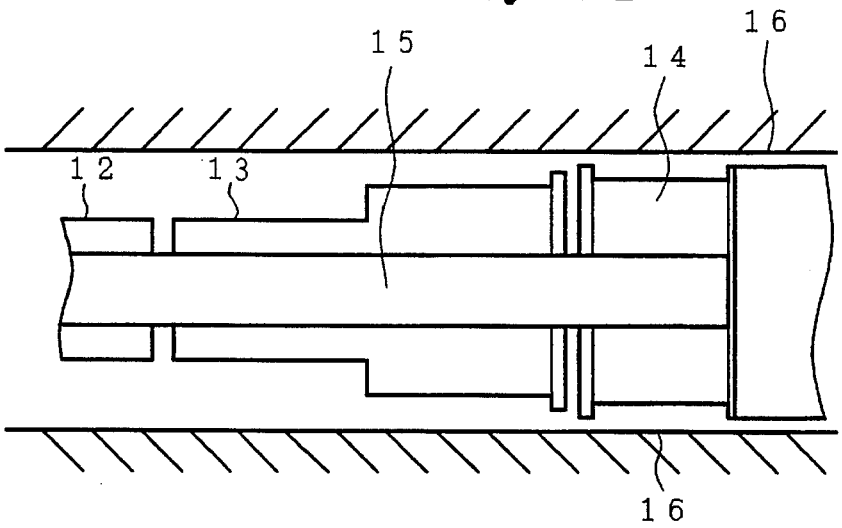
FIG. 11 is a side view showing an essential portion of the electron gun of FIG. 10 as seen from the electrode support rod side.
Figure 12:
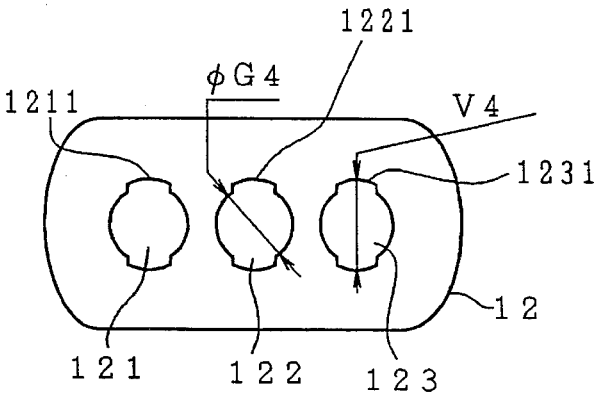
FIG. 12 is a front view of the fourth grid electrode as seen from the direction of 12—12 of FIG. 10.
Figure 13:
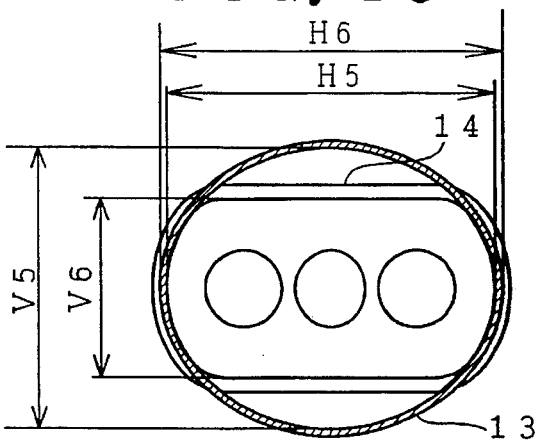
FIG. 13 is a cross section showing an essential portion of the fifth grid electrode as seen from the direction 13—13 of FIG. 10.

FIG. 10 is an explanatory view showing an electron gun installed in a third embodiment of the cathode ray tube according to this invention. FIG. 11 is a side view showing an essential portion of the electron gun, as seen from the electrode support rod side in FIG. 10. FIG. 12 is a front view of the fourth grid electrode as seen from the arrow 12—12 of FIG. 10. FIG. 13 is a cross section of the fifth grid electrode taken along the line 13—13 of FIG. 10, showing an essential portion of the fifth grid electrode.

In these figures, denoted 11 is a third grid electrode, 12 a fourth grid electrode; 13 a fifth grid electrode, 14 a sixth grid electrode, 15 an electrode support rod, and 16 a neck portion glass tube.

In FIGS. 10 and 11, the first-stage lens is made up of a third grid electrode 11, a fourth grid electrode 12 and the fifth grid electrode 13, while the second-stage lens consists of the fifth grid electrode 13 and the sixth grid electrode 14.

In FIG. 10, the third grid electrode 11 and the fifth grid electrode 13 are impressed with a focusing voltage of 5 to 10 kV, and the fourth grid electrode 12 is impressed with a high voltage of 20 to 35 kV, which is also applied commonly to the sixth grid electrode 14.

As shown in FIG. 12, the electron beam passage openings 121,122, 123 in the fourth grid electrode 12 are formed with vertical slits 1211, 1221, 1231, respectively, which elongate the electron beam cross sections horizontally as they pass through the first-stage main lens.

The fifth grid electrode 13 and the sixth grid electrode 14 are, as shown in FIG. 13, horizontally elongated in a cross section, and the increased degree of out-of-roundness of the sixth grid electrode 14 corrects the astigmatism.

Further, since the cross section of the electron beam entering the second-stage main lens is already elongated horizontally, an imbalance of the spherical aberration caused by the out-of-round shape of the second-stage main lens is compensated for, producing a circular electron beam spot on the phosphor screen.

Furthermore, since the electron gun is so constructed that the action of the first-stage lens weakens as the focusing voltage increases, a problem does not arise that the electron beam fails to focus on the phosphor screen, as will happen when the vertical focusing action is too strong at all times.

Listed below is one example of electrode dimensions for the electron gun of the above embodiment that were determined by a three-dimensional electron beam simulation.

H5(horizontal diameter of the fifth grid electrode)=20 mm

H6(horizontal diameter of the sixth grid electrode)=22 mm

V5(vertical diameter of the fifth grid electrode)=13.0 mm

V6(vertical diameter of the sixth grid electrode)=10.2 mm

V4(vertical height of a slit in the fourth grid electrode)=5.0 mm

ϕG4 (diameter of the cylindrical portion of the third, fourth and fifth grid electrode)=4.0 mm The electron beam spot on the phosphor screen produced by the electrodes of the above dimensions under the influence of spherical aberration has a degree of out-of-roundness (ratio of vertical diameter to horizontal diameter) of about 1.2, which is close to a circle. The spot diameters (horizontal and vertical diameters) with the spherical aberration are 28 percent smaller than the ones produced when the second-stage lens is ϕ15, demonstrating that the effective enlargement of the lens diameter contributes to a substantial improvement of aberration.

EMBODIMENT 4

Figure 14:
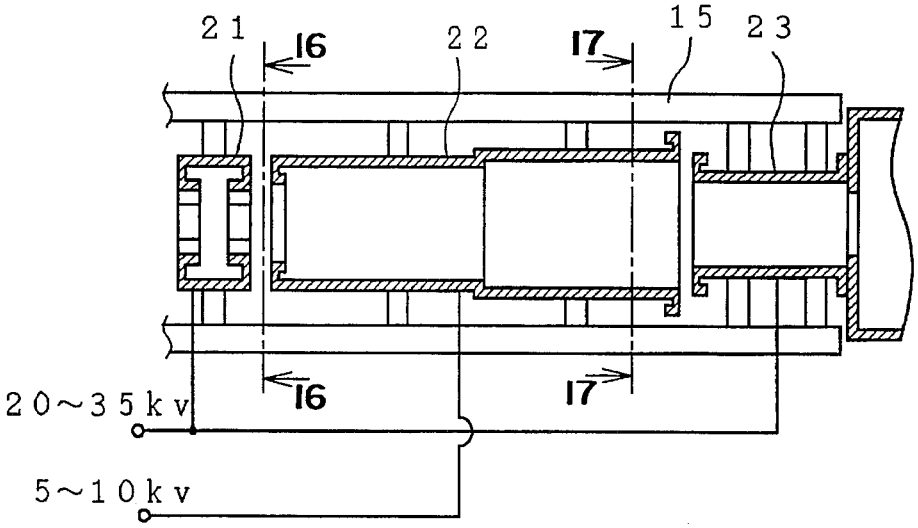
FIG. 14 is a schematic cross section showing a fourth embodiment of an electron gun used in the cathode ray tube of this invention.
Figure 15:
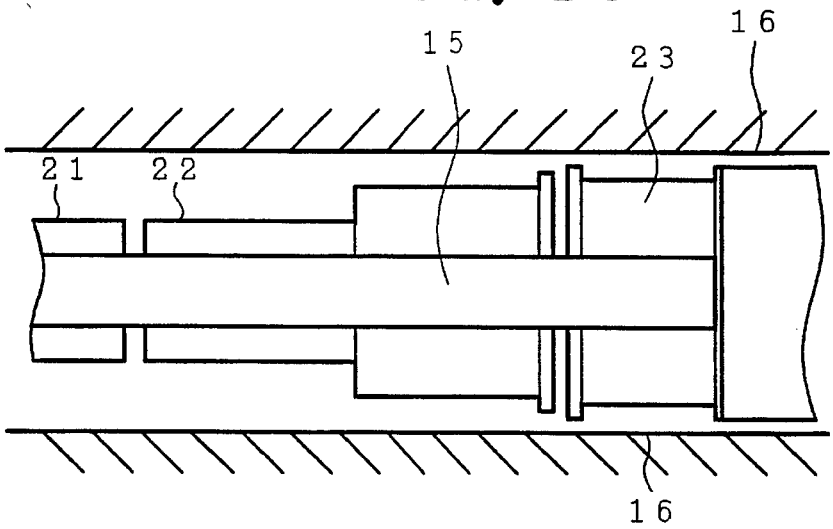
FIG. 15 is a side view showing an essential portion of the electron gun of FIG. 14 as seen from the electrode support rod side.
Figure 16:
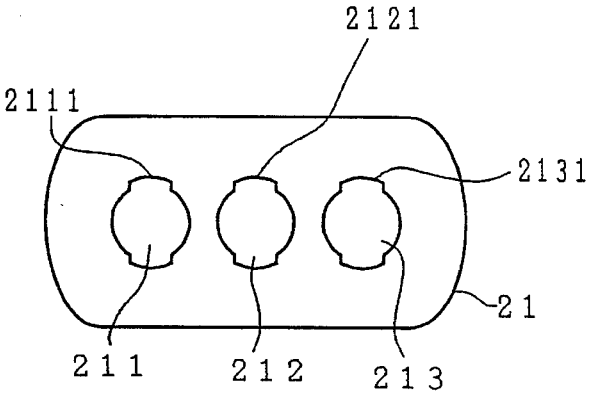
FIG. 16 is a front view of the third grid electrode as seem from the direction of 16—16 of FIG. 14.
Figure 17:
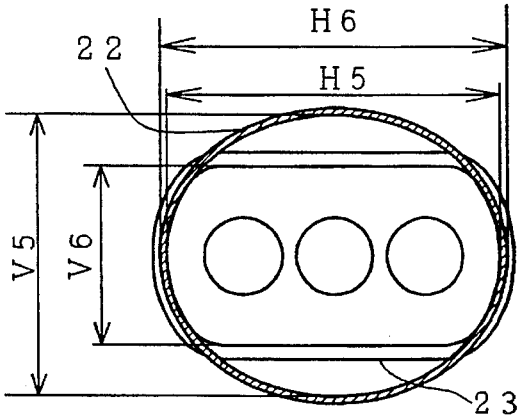
FIG. 17 is a cross section showing an essential portion of the fourth grid electrode as seen from the direction 17—17 of FIG. 14.

FIG. 14 is an explanatory view showing an electron gun installed in a fourth embodiment of the cathode ray tube according to this invention. FIG. 15 is a side view showing an essential portion of the electron gun, as seen from the side of the electrode support rod made of insulating material (for example, glass) in FIG. 14. FIG. 16 is a front view of the third grid electrode as seen from the arrow 16—16 of FIG. 14. FIG. 17 is a cross section of the fourth grid electrode taken along the line 17—17 of FIG. 14, showing an essential portion of the fourth grid electrode.

In FIG. 14 and 15, denoted 21 is a third grid electrode, 22 a fourth grid electrode, 23 a fifth grid electrode, 15 an electrode support rod, and 16 a neck portion glass tube.

In this embodiment, the first-stage lens is formed by the third grid electrode 21 and the fourth grid electrode 22, while the second-stage lens consists of the fourth grid electrode 22 and a fifth grid electrode 23. In this embodiment, the third grid electrode 21 is impressed with a high voltage of 20 to 35kV, which is also applied commonly to the fifth grid electrode 23. The fourth grid electrode 22 is impressed with a focusing voltage of around 5 to 10 kV.

As shown in FIG. 16, the electron beam passage openings 211, 212, 213 of the third grid electrode 21 are formed with vertical slits 2111, 2121, 2131, respectively, which elongate the electron beam cross sections horizontally as they pass through the first-stage main lens.

As shown in FIG. 17, the degree of out-of-roundness of the fifth grid electrode 23 is larger than that of the fourth grid electrode 22.

In this embodiment also, since the electron gun is so constructed that the action of the first-stage lens weakens as the focusing voltage increases, a problem does not arise that the electron beam fails to focus on the phosphor screen, as will happen when the vertical focusing action is too strong at all times.

Unlike the relation between the fifth grid electrode and the sixth grid electrode in Embodiment 1 and the relation between the fourth grid electrode and the fifth grid electrode in Embodiment 2, these two associated electrodes in Embodiments 3 and 4 are not in a telescoping relationship but their end surfaces oppose each other in a spaced relationship. Further, the vertical outer diameter of the low-voltage side electrode of the main lens is made smaller than a distance between a pair of electrode support rods, so that the main lens will not divide the electrode support rods.

Constructing the electrodes of the main lens in a spaced relationship reduces the number of electrode support rods in the electron gun from two pairs to one pair, thus simplifying the assembly process of the electron gun.

With this construction, while the upper limit of the vertical diameter of the low-voltage side electrode making up the main lens decreases to a dimension equal to or smaller than the distance between the paired electrode support rods, it is possible to increase the diameter of the high-voltage side electrode, which has not been possible with the prior art because of such problems as a withstand voltage. This construction therefore provides a main lens of large diameter.

The foregoing embodiments represent example cases in which this invention is applied to a color cathode ray tube that emits three electron beams. The invention is not limited to these applications but may also be applied to projection type cathode ray tubes and other types of cathode ray tubes such as those using a single electron beam. The single electron beam type cathode ray tube has a similar construction to the above embodiments, except that it has only one electron beam passage opening in each electrode. So, detailed description using drawings is omitted.

The astigmatism corrections by adjusting degrees of out-of-roundness of the main lens electrodes, as explained in the embodiments, are just examples. The similar effect can also be obtained if this invention is applied to a main lens structure in which the facing ends of the main lens electrodes are formed with recesses and protrusions to compensate for astigmatism as disclosed in the Japanese Patent Laid-Open No. 34836/1986.

As described in the foregoing, since with this invention an electron beam is elongated horizontally by the first-stage lens before it enters the second-stage lens, which has a horizontally elongated cross section with its diameter enlarged to the maximum extent, it is possible to correct an imbalance of spherical aberration resulting from imbalances among horizontal and vertical direction of the second-stage lens.

Moreover, the electron gun structure, in which increasing the focusing voltage weakens the action of the first-stage lens, eliminates a problem that the electron beam will fail to focus on the phosphor screen in the vertical direction because of the first-stage lens action to elongate the electron beam cross section horizontally.

As a result, a cathode ray tube can be obtained which fully utilizes the effect of enlarging the diameter of the main lens and has a significantly improved resolution.

What is claimed is:

1. A cathode ray tube having an electron gun comprising:

a beam generating section to generate a plurality of horizontally arranged and controlled electron beams;

a plurality of electrodes including electrodes which are arranged opposed to each other and coaxially with said electron beam generating section to form a main lens section; and said main lens section focusing said plurality of electron beams from said beam generating section onto a phosphor screen;

wherein at least one pair of electrodes among said electrodes that form said main lens section and are opposed to each other are horizontally elongated in a transverse cross section where an end of one electrode of said at least one pair of electrodes forms a lens in cooperation with an other electrode of said at least one pair of electrode;

said one electrode of said at least one pair of electrodes is impressed with a low voltage and said other electrode of said at least one pair of electrodes is impressed with a high voltage;

said main lens section has electrode means for elongating horizontally a cross section of said electron beams entering said at least one pair of electrodes;

at least one of electrodes that make up said electrode means for elongating is impressed with said low voltage; and an elongating strength of said electrode means for elongating said electron beam decreases as said low voltage increases.

2. A cathode ray tube as claimed in claim 1, wherein a degree of horizontal elongation of a cross section of said other electrode to which said high voltage is applied is larger than that of said one electrode to which said low voltage is applied.

3. A cathode ray tube as claimed in claim 1 or 2, wherein said at least one pair of electrodes are disposed in a telescoping relationship with each other.

4. A cathode ray tube as claimed in claim 3, wherein said main lens section includes a third grid electrode, a fourth grid electrode, a fifth grid electrode and a sixth grid electrode, disposed in the order named; said fourth grid electrode is formed with a vertically elongated aperture; said third grid electrode and said fifth grid electrode are impressed with said low voltage; and said fourth grid electrode and said sixth grid electrode are impressed with said high voltage.

5. A cathode ray tube as claimed in claim 4, wherein said high voltage is the same as a voltage applied to said phosphor screen.

6. A cathode ray tube as claimed in claim 3, wherein said main lens section includes a third grid electrode, a fourth grid electrode and a fifth grid electrode, disposed in the order named; said third grid electrode is formed with a vertically elongated aperture on the side facing said fourth grid electrode; said high voltage is applied to said third grid electrode and said fifth grid electrode; and said low voltage is applied to said fourth grid electrode.

7. A cathode ray tube as claimed in claim 6, wherein said high voltage is the same as a voltage applied to said phosphor screen.

8. A cathode ray tube as claimed in claim 1 or 2, wherein said at least one pair of electrodes are disposed in a spaced relationship at their facing ends.

9. A cathode ray tube as claimed in claim 8, wherein said main lens section includes a third grid electrode, a fourth grid electrode, a fifth grid electrode and a sixth grid electrode, disposed in the order named; said fourth grid electrode is formed with a vertically elongated aperture; said third grid electrode and said fifth grid electrode are impressed with said low voltage; and said fourth grid electrode and said sixth grid electrode are impressed with said high voltage.

10. A cathode ray tube as claimed in claim 9, wherein said high voltage is the same as a voltage applied to said phosphor screen.

11. A cathode ray tube as claimed in claim 8, wherein said main lens section includes a third grid electrode, a fourth grid electrode and a fifth grid electrode, disposed in the order named; said third grid electrode is formed with a vertically elongated aperture on the side facing said fourth grid electrode; said high voltage is applied to said third grid electrode and said fifth grid electrode; and said low voltage is applied to said fourth grid electrode.

12. A cathode ray tube as claimed in claim 11, wherein said high voltage is the same as a voltage applied to said phosphor screen.

13. A cathode ray tube having an electron gun comprising:

a beam generating section for generating a single controlled electron beam;

a plurality of electrodes including electrodes which are arranged opposed to each other and coaxially with said electron beam generating section to form a main lens section; and said main lens section focusing said single electron beam from said beam generating section onto a phosphor screen;

wherein at least one pair of electrodes among said electrodes that form said main lens section and are opposed to each other are elongated in an arbitrary direction in a transverse cross section where an end of one electrode of said at least one pair of electrodes forms a lens in cooperation with an other electrode of said at least one pair of electrodes;

said one electrode of said at least one pair of electrodes is impressed with a low voltage and said other electrode of said at least one pair of electrodes is impressed with a high voltage;

said main lens section has electrode means for elongating in said arbitrary direction a cross section of said electron beams entering said at least one pair of electrodes;

at least one of electrodes that make up said electrode means for elongating is impressed with said low voltage; and an elongating strength of said electrode means for elongating said electron beam decreases as said low voltage increases.

14. A cathode ray tube as claimed in claim 13, wherein a degree of elongation in said arbitrary direction of said other electrode to which said high voltage is applied is larger than that of said one electrode to which said low voltage is applied.

15. A cathode ray tube as claimed in claim 13 or 14, wherein said at least one pair of electrodes are disposed in a telescoping relationship with each other.

16. A cathode ray tube as claimed in claim 15, wherein said main lens section includes a third grid electrode, a fourth grid electrode, a fifth grid electrode and a sixth grid electrode, disposed in the order named; said fourth grid electrode is formed with an aperture which is elongated in a direction perpendicular to said arbitrary direction; said third grid electrode and said fifth grid electrode are impressed with said low voltage; and said fourth grid electrode and said sixth grid electrode are impressed with said high voltage.

17. A cathode ray tube as claimed in claim 16, wherein said high voltage is the same as a voltage applied to said phosphor screen.

18. A cathode ray tube as claimed in claim 15, wherein said main lens section includes a third grid electrode, a fourth grid electrode and a fifth grid electrode, disposed in the order named, said third grid electrode is formed with an aperture on the side facing said fourth grid electrode, which is elongated in a direction perpendicular to said arbitrary direction; said high voltage is applied to said third grid electrode and said fifth grid electrode; and said low voltage is applied to said fourth grid electrode.

19. A cathode ray tube as claimed in claim 18, wherein said high voltage is the same as a voltage applied to said phosphor screen.

20. A cathode ray tube as claimed in claim 13 or 14, wherein said at least one pair of electrodes are disposed in a spaced relationship at their facing ends.

21. A cathode ray tube as claimed in claim 20, wherein said main lens section includes a third grid electrode, a fourth grid electrode, a fifth grid electrode and a sixth grid electrode, disposed in the order named; said fourth grid electrode is formed with an aperture which is elongated in a direction perpendicular to said arbitrary direction; said third grid electrode and said fifth grid electrode are impressed with said low voltage; and said fourth grid electrode and said sixth grid electrode are impressed with said high voltage.

22. A cathode ray tube as claimed in claim 21, wherein said high voltage is the same as a voltage applied to said phosphor screen.

23. A cathode ray tube as claimed in claim 20, wherein said main lens section includes a third grid electrode, a fourth grid electrode and a fifth grid electrode, disposed in the order named; said third grid electrode is formed with an aperture on the side facing said fourth grid electrode, which is elongated in a direction perpendicular to said arbitrary direction; said high voltage is applied to said third grid electrode and said fifth grid electrode; and said low voltage is applied to said fourth grid electrode.

24. A cathode ray tube as claimed in claim 23, wherein said high voltage is the same as a voltage applied to said phosphor screen.

* * * * *